US006342913B1

(12) United States Patent
Sasaki

(10) Patent No.: US 6,342,913 B1
(45) Date of Patent: Jan. 29, 2002

(54) IMAGE RECORDING APPARATUS

(75) Inventor: Yoshiharu Sasaki, Shizuoka (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/455,914

(22) Filed: Dec. 7, 1999

(30) Foreign Application Priority Data

Dec. 8, 1998 (JP) ..... 10-348677

(51) Int. Cl.[7] ..... B41J 2/435
(52) U.S. Cl. ..... 347/247; 347/237
(58) Field of Search ..... 347/237, 238, 347/247, 255, 239, 136, 253; 369/116, 122; 359/237, 244; 372/38.02

(56) References Cited

U.S. PATENT DOCUMENTS

| | | | | |
|---|---|---|---|---|
| 4,814,791 A | * | 3/1989 | Ohara et al. | 347/253 |
| 4,928,277 A | * | 5/1990 | Monma et al. | 369/116 |
| 5,463,648 A | * | 10/1995 | Gibbs | 372/38.02 |

FOREIGN PATENT DOCUMENTS

| | | | | |
|---|---|---|---|---|
| EP | 0 803 764 A1 | | 10/1997 | G03C/1/498 |
| EP | 0 803 765 A1 | | 10/1997 | G03C/1/498 |
| JP | 4-211252 | | 8/1992 | G03F/7/004 |
| JP | 4-249251 | | 9/1992 | G03F/7/004 |
| JP | 4-296594 | | 10/1992 | B41M/5/40 |
| JP | 4-327982 | | 11/1992 | B41M/5/26 |
| JP | 4-327983 | | 11/1992 | B41M/5/26 |
| JP | 5-113629 | | 5/1993 | G03C/5/08 |
| JP | 5-330127 A | * | 12/1993 | B41J/2/44 |
| JP | 6-275183 | | 9/1994 | H01H/37/32 |
| JP | 8-62803 | | 3/1996 | G03C/8/26 |
| JP | 8-211521 | | 8/1996 | G03C/1/00 |
| JP | 9-61978 | | 3/1997 | G03C/8/40 |
| JP | 9-152705 | | 6/1997 | G03C/8/12 |
| JP | 9-258404 | | 10/1997 | G03C/8/40 |
| JP | 9-274295 | | 10/1997 | G03C/8/40 |
| JP | 10-71740 | | 3/1998 | B41J/2/44 |

* cited by examiner

*Primary Examiner*—Hai C. Pham
(74) *Attorney, Agent, or Firm*—Sughrue Mion, PLLC

(57) ABSTRACT

An optical shutter is provided in the middle of a triopical path of the recording laser. Before a recording operation of data such as the images and the characters, the optical shutter is closed and also a recording laser light is outputted from the LD at a predetermined output rate. Then, immediately before the recording start of the data, the output of the recording laser is interrupted and also the optical shutter is opened, and then the recording of the data is started. Accordingly, there can be provided the image recording apparatus which is able to set the recording laser into its stabilized output state to record immediately after the recording start and to prevent generation of the irregularity of the images, the unevenness of the line width, etc.

10 Claims, 3 Drawing Sheets

IMAGE RECORDING APPARATUS

BACKGROUND OF THE INVENTION

1. Field of the Invention

The present invention relates to an image recording apparatus for recording data such as images, characters, etc. onto a recording medium by using a recording laser and, more particularly, technology of recording data by stabilizing a laser light.

2. Description of the Related Art

In the image recording apparatus which has a laser light source (LD) and forms the images by irradiating the recording laser light emitted from the LD onto the recording medium, when the image data are input, the LD must output a predetermined power even in its standby state where the recording operation is not carried out for a moment after the power supply is turned on. In order to output the predetermined power from the LD, a current which corresponds to the predetermined power must be supplied. At that time, sometimes the desired power cannot be obtained even if a predetermined constant current is supplied to the LD. This is because the LD has the inherent characteristic such that it has a relatively high output when the temperature of the LD is low but it has a relatively low output when the temperature of the LD is high.

Because of this characteristic, the laser light which mates with the image data is output from the LID and at the same the heat is generated when the image data are input into the LD. Since this heat increases the temperature of the LD, the power of the laser to respond to the input current is changed.

For this reason, normally the image recording apparatus heats/cools the LD by using the Peltier element, etc. to control the temperature of the LD such that the LD can be always set at a predetermined temperature (e.g., the steady recording temperature of 25° C.) by the temperature controller in order to keep the output characteristic of the LD constant.

However, the temperature controller causes following problems. That is, in the standby state where the power supply of the image recording apparatus is turned on, normally the laser light is not output from the LD and also the temperature control is performed by heating/cooling the LD so as to maintain the LD at the steady recording temperature by using the temperature controller. At this time, if the image data are input abruptly into the LD, the LD generates the heat due to the laser light output and thus the LD itself is heated. Then, the temperature controller cools the LD so as to shift the LD from the increased temperature to the steady recording temperature. Therefore, the temperature of the LD is decreased, but such temperature is lowered excessively low rather than the steady recording temperature as the case may be. Then, the temperature controller heats the LD so as to shift the LD from the excessively low temperature to the steady recording temperature. Finally, the temperature of the LD can be converged to the steady recording temperature after the repetition of above steps, nevertheless the output characteristic of the laser is changed each time when the temperature is changed to come up to the convergence. As the result of this, irregularity of the recorded images is caused, or a thickness of the recorded line is changed, or the light emitting position is changed.

Meanwhile, in case the recording is made onto the transfer type recording medium in the heat mode by using the recording laser, the sensitivity is degraded in three to five figures rather than the case where the recording is made onto the photographic film, the lith film, etc. Therefore, the high output recording laser is employed as the light source. In this case, the output characteristic of the LD is largely changed because such high output recording laser has a large heating value, and thus a possibility to reduce extremely the picture quality is increased higher.

SUMMARY OF THE INVENTION

The present invention has been made in view of such circumstance, and it is an object of the present invention to provide an image recording apparatus which can set the recording laser to its stable output state and record the data immediately after the recording is started and can prevent generation of irregularity of the images, unevenness of the line width, the change in the light emitting position, etc.

In order to overcome the above object, an image recording apparatus set forth in claim 1 of the present invention, for recording data of images and characters on a recording medium by using a recording laser, comprising an optical shutter provided in a middle of an optical path of the recording laser to pass or shut off a laser light; and a controller for controlling to close the optical shutter and also output a recording laser light at a predetermined output rate before a data recording operation onto the recording medium, then to interrupt an output of the recording laser and open the optical shutter immediately before recording start of the data, and then start recording of the data.

According to the image recording apparatus, the optical shutter provided in the middle of the optical path of the recording laser is closed and also the recording laser is caused to output the laser light at the predetermined output rate before the data such as the images and the characters are recorded, and the temperature of the recording laser (LD) can be set to the thermal loading state, which is substantially equal to the steady recording state, prior to the recording start. Then, the output of the recording laser is turned off and also the optical shutter is opened immediately before the recording start, and then the recording is started by outputting the recording laser light to coincide with the image data. Therefore, the LD can start the image recording from the temperature which is close to the steady recording state at the time of the recording start and also an amount of change in the temperature of the LD can be reduced. Accordingly, the image recording can be achieved in the stabilized output state of the LD and the input/output characteristic of the LD, and therefore the high quality image recording can be attained.

Preferably, the predetermined output rate is an output rate which mates with a pulse signal generated at a predetermined duty ratio.

According to the image recording apparatus, if the data are recorded on the recording medium which is formed of the binary photosensitive material, the output of the LD can be properly controlled by employing the pulse signal which repeats ON/OFF at predetermined constant intervals.

Preferably, the predetermined output rate is an output rate which mates with a continuous signal having a predetermined intensity level.

According to the image recording apparatus, if the data are recorded on the recording medium which is formed of density gradation recording material, the output of the LD can be properly controlled by employing the continuous signal having the predetermined intensity level.

A first aspect of the apparatus is an image recording apparatus for recording data of images and characters on a recording medium by using a recording laser, comprising:

an optical shutter provided in a middle of an optical path of the recording laser to pass or shut off a laser light; and a controller for controlling to close the optical shutter and also controlling to drive a recording laser light at a constant laser output rate so as to pre- heat the recording laser before a data recording operation onto the recording medium, then controlling to interrupt an output of the recording laser and open the optical shutter before recording start of the data, and then start recording of the data by driving the recording laser.

A second aspect of the apparatus is an image recording apparatus according to the first aspect, wherein the controller control the recording laser to be driven immediately before recording start of the data.

A third aspect of the apparatus is an image recording apparatus according to the first aspect, wherein the output rate is an output rate which mates with a pulse signal generated at a constant duty ratio.

A fourth aspect of the apparatus is an image recording apparatus according to the first aspect, wherein the output rate is an output rate which mates with a pulse signal generated at a constant duty ratio determined so that the recording laser is heated itself up to a temperature of the recording laser on recording step.

A fifth aspect of the apparatus is an image recording apparatus according to the first aspect, wherein the output rate is an output rate which mates with a continuous signal having a constant intensity level.

A sixth aspect of the apparatus is an image recording apparatus according to the first aspect, wherein the output rate is an output rate which mates with a continuous signal having a constant intensity level determined so that the recording laser is heated itself up to a temperature of the recording laser on recording step.

A seventh aspect of the apparatus is an image recording apparatus according to the first aspect, wherein the controller control the recording laser to be driven to start preheating and preparing for recording, at the same time when a recording signal is input.

An eight aspect of the apparatus is an image recording apparatus according to the first aspect, wherein the controller opens the shutter and drives the recording laser to put into a recording mode, at a time when the pulse signal is low level.

A ninth aspect of the apparatus is an image recording apparatus according to the eighth aspect, wherein the pulse signal has a duty ratio of 50%.

A tenth aspect of the apparatus is an image recording apparatus according to the first aspect, wherein the recording laser can change an output level intensity and can be controlled to multi-tone recording

DETAILED DESCRIPTION OF THE PREFERRED EMBODIMENTS

Figure 1:
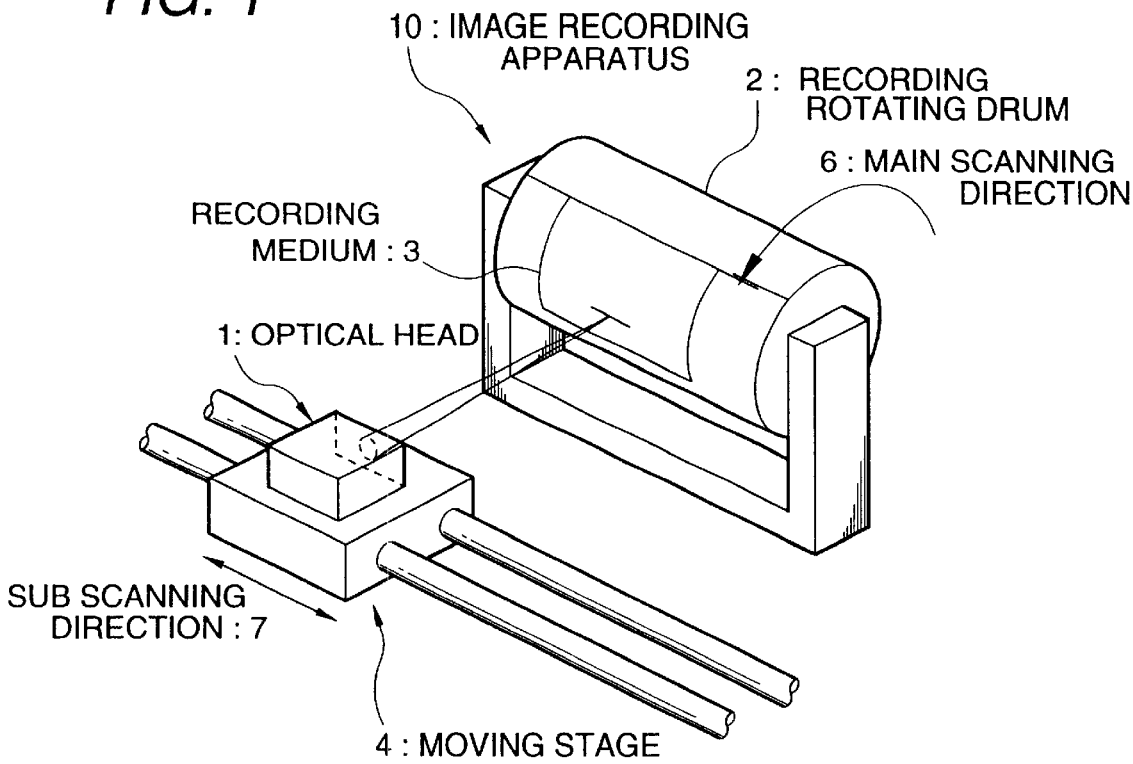
FIG. 1 is a perspective view showing a configuration of an image recording apparatus according to the present invention.
Figure 2:
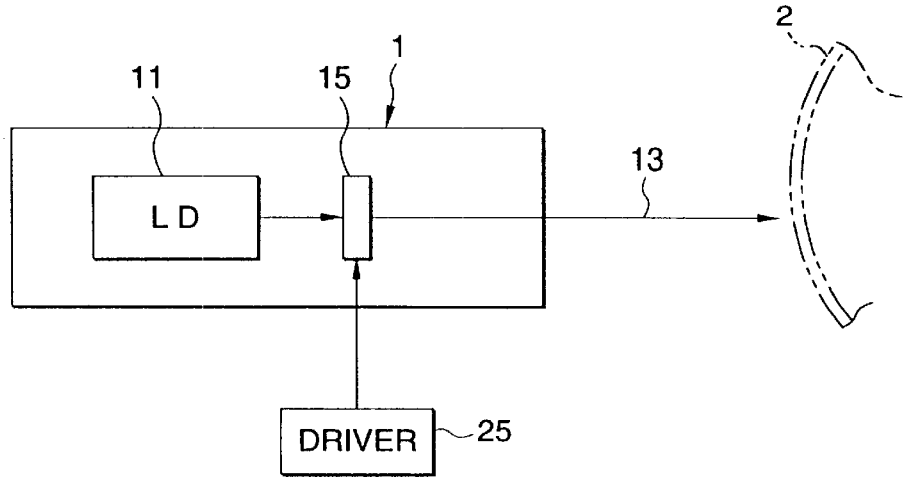
FIG. 2 is a view showing a configuration of pertinent portions of an optical head shown in FIG.1.
Figure 3:
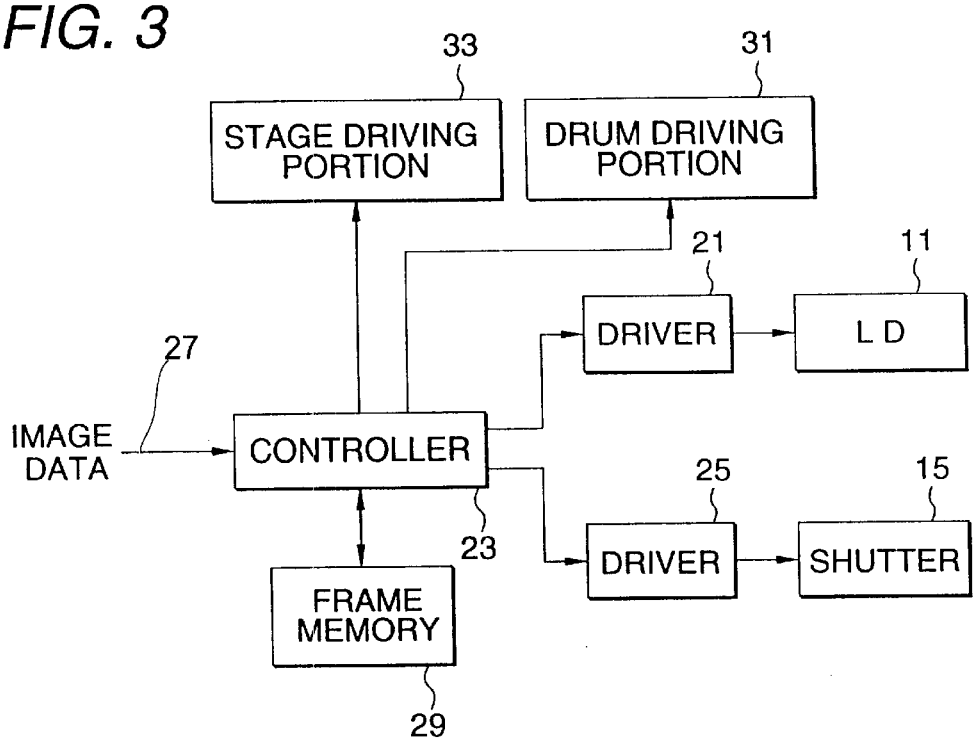
FIG. 3 is a view showing a schematic configuration of peripheral circuits of a controller.

An image recording apparatus according to a preferred embodiment of the present invention will be explained in detail with reference to the accompanying drawings hereinafter. FIG. 1 is a perspective view showing a configuration of an image recording apparatus according to the present invention. FIG. 2 is a view showing a configuration of pertinent portions of an optical head shown in FIG. 1. FIG. 3 is a view showing a schematic configuration of peripheral circuits of a controller.

As shown in FIG. 1, the image recording apparatus according to the present comprises: an optical shutter 15 provided in a middle of an optical path 13 of the recording laser 11 to pass or shut off a laser light; and a controller 23 for controlling to close the optical shutter and also controlling to drive a recording laser light at a constant laser output rate so as to pre-heat the recording laser 11 before a data recording operation onto the recording medium, then controlling to interrupt an output of the recording laser 11 and open the optical shutter 15 before recording start of the data, and then start recording of the data by driving the recording laser. And the apparatus is constructed to comprise an optical head 1 which has a plurality of laser beams, and a recording rotating drum 2 which has a recording medium 3 on its external peripheral surface and is supported rotatably. The optical head 1 modulates ON/OFF of respective laser beams according to recording data, and is moved in the direction parallel with a rotation axis.

The optical head 1 is set on a moving stage 4 which can be moved in parallel with the recording rotating drum 2. This movement corresponds to the sub scanning direction upon forming the image. In contrast, the rotation direction of the recording rotating drum 2 corresponds to the main scanning direction. In this case, the recording rotating drum 2 in place of the optical head 1 may be moved along the sub scanning direction. In other words, the optical head 1 and the recording rotating drum 2 may be relatively moved along the drum axis direction to achieve the sub scanning movement.

As shown in FIG. 2, an optical shutter 15 is provided in the middle of an optical path 13 of the recording laser which is emitted from a laser light source (LD) 11 built in the optical head 1. Open/close of the optical shutter 15 is controlled by the controller via a driver 25 described later. If the optical shutter 15 can withstand the laser light emitted from the recording laser, any type of the optical shutter which shuts off the light mechanically, electrically, and optically may be employed. For example, preferably the optical shutter having an iris opening/closing mechanism which is driven by a circular plate with an opening, a solenoid, etc. may be considered as the mechanical shutter.

Next, the controller portion of the embodiment will be explained hereunder. As shown in FIG. 3, the LD 11 is connected to the controller 23 via the driver 21, while the optical shutter 15 is connected to the controller 23 via the driver 25. A signal line 27 for inputting the image data from an external device is connected to the controller 23. The image data to be recorded onto the recording medium 3 are input from the external device via the signal line 27. Also, a frame memory 29 for storing the image data is connected to the controller 23 and also a drum driving portion 31 for rotating the recording rotating drum 2 and a stage driving portion 33 for moving the moving stage 4 (and the optical head 1) are connected to the controller 23 respectively.

Next, the recording medium employed in this embodiment will be explained hereunder.

Figure 4:
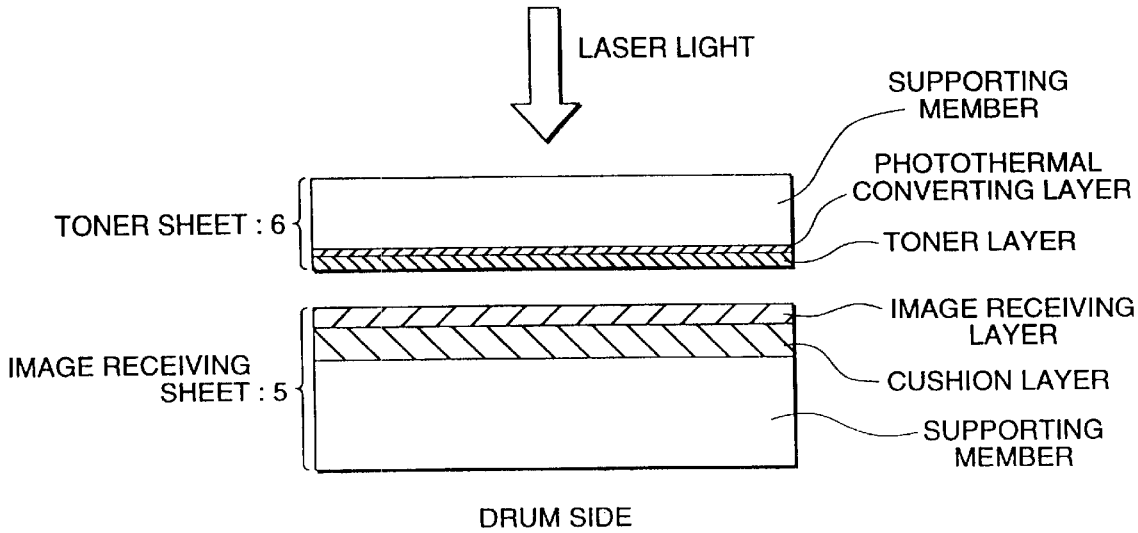
FIG. 4 is a view showing a configuration of a recording medium employed in the image recording apparatus according to an embodiment of the present invention.

As shown in FIG. 4 as an example, the image receiving sheet 5 comprises a supporting member, a cushion layer, and an image receiving layer in sequence from the recording rotating drum 2 side. The toner sheet 6 comprises a supporting member, a photothermal converting layer, and a toner layer in sequence from the laser light irradiation side. The image receiving sheet 5 is mounted on the recording rotating drum 2. The toner sheet 6 is stacked on the image receiving sheet 5 to direct the toner layer to the image receiving sheet 5 side. When the laser beam is irradiated onto the toner sheet 6 from the opposite side of the image receiving sheet 5 side, the irradiated portion of the toner layer is transferred on the image receiving layer by the heat.

The material which can transmit the laser beam, e.g., PET (polyethylene terephthalate) base, TAC (triacetylcellulose) base, PEN (polyethylene naphthalate) base, etc. may be employed as the supporting member. Also, the material which can convert the laser energy into the heat effectively, e.g., carbon black, infrared absorbing dye, specific wavelength absorbing substance, etc. may be employed as the photothermal converting layer. Respective KCMY toner sheets may be employed as the toner layer. Also, in some cases toner sheets of gold, silver, light brown, gray, orange, green, etc. may be employed. The image receiving layer acts to receive the transferred toner. In addition, the cushion layer acts to absorb the difference in level when the toners are stacked in plural stages and the difference in level caused due to the dust.

In this event, more detailed contents of the image receiving sheet 5 and the toner sheet 6, which serve as the recording medium 3 employed in the image recording apparatus according to the first embodiment, are set forth in Patent Application Publication (KOKAI) Hei 4-296594, Patent Application Publication (KOKAI) Hei 4-327982, Patent Application Publication (KOKAI) Hei 4-327983, etc. filed by the applicant of this application and also the image recording apparatus employing such recording medium has been described in detail in Patent Application Publication (KOKAI) Hei 6-275183. Therefore, please see the above references if necessary.

Figure 5:
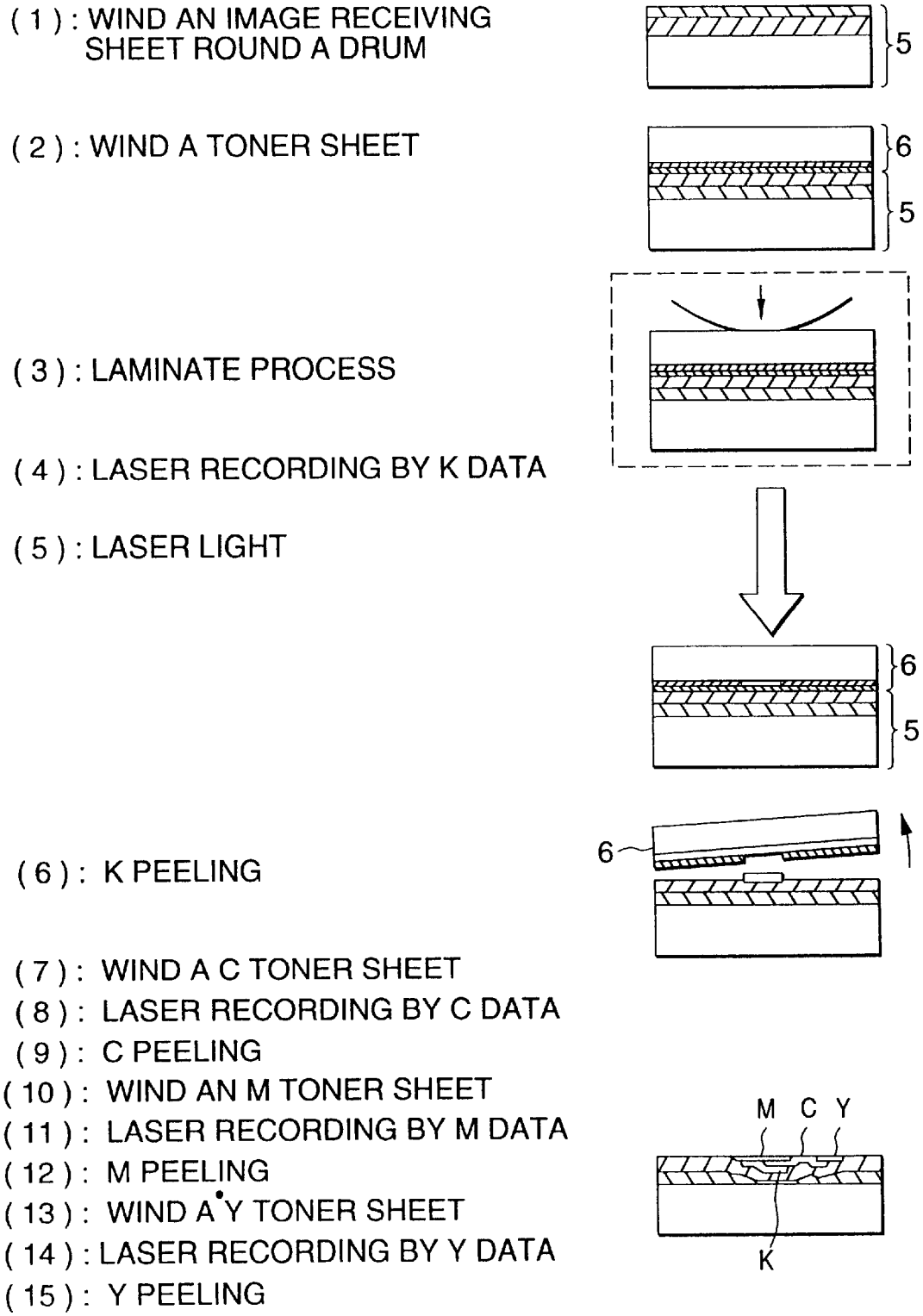
FIG. 5 is a view showing an actual example of recording steps which are applied to respective colors of KCMY.

Then, the step of performing the laser recording by each color data of KCMY, and the step of peeling the toner sheet 6 from the image receiving sheet 5 after recording will be explained. In this case, if the laminate process is carried out, such laminate process is executed prior to the laser recording step. Respective steps will be explained sequentially with reference to FIG. 5 hereinbelow.

1) Wind the image receiving sheet 5 round the recording rotating drum 2.

2) First, wind the K toner sheet 6 onto the image receiving sheet 5 to execute the K step.

3) Irradiate the laser light to record K image/character data.

4) Then, peel off the K toner sheet 6 from the image receiving sheet 5 (end of the K step).

5) Then, execute the C step. That is, wind a C toner sheet onto the image receiving sheet.

6) Execute the laser recording by C data.

7) Finally, peel off the C toner sheet from the image receiving sheet (end of the C step).

8) Then, execute the M step. That is, wind an M toner sheet onto the image receiving sheet.

9) Execute the laser recording by M data.

10) Peel off the M toner sheet from the image receiving sheet (end of the M step).

11) Then, execute the Y step. That is, wind a Y toner sheet onto the image receiving sheet.

12) Execute the laser recording by Y data.

13) Finally, peel off the Y toner sheet from the image receiving sheet (end of the Y step).

14) In this manner, four colors of KCMY are appropriately laminated or not laminated on the image receiving sheet, and thus necessary color image can be achieved.

15) Transfer the color image onto the sheet.

In this case, if the laminate process is carried out, the toner sheet can be tightly contacted with the image receiving sheet by pushing the toner sheet by virtue of a pressurizing roller, a heating roller, etc. every color immediately before the laser recording.

In the above recording step, it is desired that the recording speed is set in the range of 0.5 to 50 [m/s], preferably the range of 1 to 16 [m/s]. The above mentioned are basic operations of the image recording apparatus.

Then, an image recording operation of the image recording apparatus 10 having the above configuration will be explained in detail.

In the image recording apparatus 10, when image data signals of the image to be recorded are input in the standby state where the image recording is not executed after the power supply on, the controller 23 performs recording preparatory operations, e.g., rotates the recording rotating drum 2, on which the recording medium 3 is fitted, relative to the drum driving portion 31 and the stage driving portion 33 to move the optical head 1 to a recording starting position, etc. More particularly, the carry/cut process, the image data process, etc. of the recording medium 3 are carried out. Before the preparatory operation prior to the recording start, the controller 23 closes the optical shutter 15 via the driver 25 and then causes the LD 11 to emit the laser light at a predetermined output rate via the driver 21. Before the recording start, the temperature of the LD 11 can be increased up to the temperature, which is substantially identical to the steady recording temperature, by the output of the laser light at this time. Of course, this operation may be carried out simultaneously in parallel with the above preparatory operation.

The optical shutter 15 is kept by the controller 23 in its shut-off state during the output of the laser light such that the laser light emitted from the LD 11 cannot be irradiated onto the recording medium 3.

Then, after the above recording preparatory operation has been completed, the output of the LD 11 is interrupted once by the controller 23 immediately before the recording start and then the optical shutter 15 is opened. In turn, the recording is started by ON/OFF-controlling (or multitone-controlling) the LD 11 according to the image data.

Like this, it is preferable that the LD output start timing before the image recording should be set immediately before the image recording of the image recording apparatus 10. The LD output start timing may be set to the time of the power supply on of the image recording apparatus 10. In this case, the LD 11 continues to output until the image data are input after the power supply has been turned on. If the standby time is long, a lifetime of the LD 11 is shortened excessively. Therefore, if the LD 11 outputs the laser light within the recording preparatory operation after the recording data are input into the image recording apparatus 10, the LD 11 can be set effectively to the temperature in the vicinity of the steady recording temperature without loss of the time and thus the LD 11 can be prevented from outputting wastefully for a long time. Therefore, reduction in the lifetime can be suppressed.

As the input signal to the ID 11 to increase the temperature up to the steady recording temperature, a duty signal which repeats ON/OFF at predetermined constant time intervals may be employed since the output of the LD has a constant value in recording of the image recording apparatus 10. For example, the output of the LD 11 can be properly controlled by setting the duty ratio to about 50%.

In addition, in case the data are recorded by the system in which the LD output can be varied, a continuous signal having a predetermined constant level may be employed. For example, the output of the LD 11 can be properly controlled by continuously inputting the signal which has a level of about 50% of the maximum output level.

Further, the output of the LD 11 may be controlled by using the method employing these signals in combination. According to such control, the images can be recorded under appropriate conditions respectively if the recording medium is formed of either the binary photosensitive material or the density gradation photosensitive material.

Next, in order to record the image data onto the recording medium 3, the image data being input into the image recording apparatus 10 is stored once in the frame memory 29, and then the recording rotating drum 2 is rotated at a constant velocity and also the optical head 1 is moved to the recording start position. Then, the voltage is applied selectively to parallel elements or a plurality of light emitting elements of the LD 11 in unit of pixel in compliance with the image recording sequence of the optical head 1 onto the recording medium 3. Accordingly, the laser light is emitted from the optical head 1, then the emitted recording laser light is irradiated onto the recording medium 3, and then the image is recorded along the main scanning direction. After one main scanning has been completed, the controller 23 causes the moving stage 4 and the optical head 1 to move sequentially. The sub scanning of the recording laser light is performed by this operation. The image can be recorded onto the recording medium 3 by repeating the sub scanning.

As described above, since, in the recording preparatory period when the data such as the images and the characters are recorded, the optical shutter 15 positioned in the middle of the optical path 13 is closed and also the laser light is output from the LD 11 according to the signal having the predetermined output rate, e.g., the pulse signal which is generated to have a predetermined duty ratio, or the continuous signal having the predetermined intensity level, or the combination signal of these signals, the LD 11 can be set to the temperature loading state, which is substantially equal to the steady recording state, prior to the recording start of the LD 11. Also, because adjustment of the temperature of the LD 11 is performed in the recording preparatory period, such adjustment can be done effectively without loss of the time. In addition, since the output of the LD 11 is interrupted once immediately before the recording start and also the optical shutter 15 is opened and then the image recording is started in compliance with the image data, the laser light can be prevented without fail from being irradiated onto the recording medium 3 before the recording start.

In this manner, since the LD 11 can perform the image recording from the predetermined steady recording temperature at the time of the recording start, variation in the LD temperature due to the temperature control of the LD 11 by the controller 23 can be considerably reduced. As a result, the images can be recorded in the stabilized output state and also the input/output characteristic of the LD 11 can be kept substantially constant, so that the high quality image output can be achieved.

In the above embodiment, the configuration is disclosed in which the recording medium 3 is fitted on the recording rotating drum 2, and then the optical head 1 is scanned while rotating the recording rotating drum 2 to form the images. However, the present invention is not limited to the configuration. The present invention may be similarly applied to a configuration in which the laser light emitted from the LD 11 is scanned/exposed onto the recording medium by using a reflection mirror such as a polygon mirror, etc. while carrying the recording medium by using a roller, etc. to form the images.

Next, the recording medium 3 may be applied to overall recording materials of the dry developing system described in the following.

(1) The system in which the images can be transferred onto the image receiving material by superposing the photosensitive material, which is exposed like the image, and the image receiving material and then heating them (and applying the pressure if necessary) so as to mate with the latent images formed on the photosensitive material by the exposure (for example, such system is set forth in Patent Application Publication (KOKAI) Hei 5-113629, Patent Application Publication (KOKAI) Hei 9-258404, Patent Application Publication (KOKAI) Hei 9-61978, Patent Application Publication (KOKAI) Hei 9-61978, Patent Application Publication (KOKAI) Hei 8-62803, Patent Application Publication (KOKAI) Hei 10-71740, Patent Application Publication (KOKAI) Hei 9-152705, Patent Application Publication (KOKAI) Hei 10-90181, Patent Application Publication (KOKAI) Hei 10-13326, and Patent Application Publication (KOKAI) Hei 10-18172). The recording material of this system corresponds to the recording medium 3 shown in the first to seventh embodiments.

(2) The system in which the images can be formed onto the photosensitive material by superposing the photosensitive material, which is exposed like the image, and the processing material and then heating them so as to mate with the latent images formed on the photosensitive material by the exposure (for example, such system is set forth in Patent Application Publication (KOKAI) Hei 9-274295, Patent Application Publication (KOKAI) Hei 10-17192, etc.)

(3) The system in which the latent images formed by the exposure are changed into the visible images by exposing the photosensitive material having the photosensitive layer, in which silver halide acting as the optical catalyst, silver salt acting as the image forming material, reducing agent for silver ion, etc. are dispersed into the binder, like the images and then heating the photosensitive material at a predetermined temperature (for example, such system is set forth in "Thermally Processed Silver Systems", B. Shely, Imaging Processes and Materials, Neblette version 8, edited by V. Walworth, A. Shepp, p.2, 1996, Research Disclosure 17029 (1978), EP803764A1, EP803765A1, and Patent Application Publication (KOKAI) Hei 8-211521.)

(4) The system in which the photosensitive/thermosensitive recording material is employed. More particularly, the system in which such photosensitive/thermosensitive recording layer utilizes the recording material which contains the electron-releasing achromatic dye included in the microcapsule, and the compound, which includes the electron acceptor portion and the polymerization vinyl monomer portion in the same molecule, and the photopolymerization initiator on the outside of the microcapsule (for example, such system is set forth in Patent Application Publication (KOKAI) Hei 4-249251, etc.), or the system in which such photosensitive/thermosensitive recording layer utilizes the recording material which contains the electron-releasing achromatic dye included in the thermally responsible microcapsule, and the electron acceptive compound, the polymerization vinyl monomer, and the photopolymerization initiator on the outside of the microcapsule (for example, such system is set forth in Patent Application Publication (KOKAI) Hei 4-211252, etc.).

As described in detail above, according to the image recording apparatus, since the optical shutter is provided in the middle of the optical path of the recording laser, and then the optical shutter is closed and also the recording laser outputs its output at the predetermined output rate before the data such as the images and the characters are recorded, the temperature of the recording laser can be set to the thermal loading state, which is substantially equal to the steady recording state, prior to the recording start. Then, the output of the recording laser is interrupted once immediately before the recording start and the optical shutter is opened, and then the recording of the data onto the recording medium is started.

Therefore, since the LD can start the image recording from the temperature which is close to the steady recording state at the time of the recording start and an amount of change in the temperature of the LD can be reduced, the image recording can be achieved in the stabilized output state. As a result, the change in the input/output characteristic of the LD due to the temperature change of the recording laser can be prevented, and therefore the high quality image recording can be attained since irregularity of the recording images can be eliminated, variation in thickness of the recording line can be prevented, and change of the light emitting position can be extremely reduced.

What is claimed is:

1. An image recording apparatus for recording data of images and characters on a recording medium by using a recording laser, comprising:

an optical shutter provided in a middle of an optical path of the recording laser to pass or shut off a laser light; and a controller for controlling to close the optical shutter and also controlling to drive a recording laser light at a constant laser output rate so as to pre-heat the recording laser before a data recording operation onto the recording medium, then controlling to interrupt an output of the recording laser and open the optical shutter before recording start of the data, and then start recording of the data by driving the recording laser.

2. An image recording apparatus according to claim 1, wherein the controller control the recording laser to be driven immediately before recording start of the data.

3. An image recording apparatus according to claim 1, wherein the output rate is an output rate which mates with a pulse signal generated at a constant duty ratio.

4. An image recording apparatus according to claim 3, wherein the controller opens the shutter and drives the recording laser into a recording mode, at a time when the pulse signal is low level.

5. An image recording apparatus according to claim 4, wherein the pulse signal has a duty ratio of 50%.

6. An image recording apparatus according to claim 1, wherein the output rate is an output rate which mates with a pulse signal generated at a constant duty ratio determined so that the recording laser is heated itself up to a temperature of the recording laser on recording step.

7. An image recording apparatus according to claim 1, wherein the output rate is an output rate which mates with a continuous signal having a constant intensity level.

8. An image recording apparatus according to claim 1, wherein the output rate is an output rate which mates with a continuous signal having a constant intensity level determined so that the recording laser is heated itself up to a temperature of the recording laser on recording step.

9. An image recording apparatus according to claim 1, wherein the controller control the recording laser to be driven to start preheating and preparing for recording, at the same time when a recording signal is input.

10. An image recording apparatus according to claim 1, wherein the recording laser can change an output level intensity and can be controlled to multi-tone recording.

* * * * *